US005295377A

United States Patent [19]

Moricz et al.

[11] Patent Number: 5,295,377

[45] Date of Patent: Mar. 22, 1994

[54] BURGLAR PROOF LOCK, ESPECIALLY LOCK FOR CARS

[76] Inventors: Ferenc Moricz; Zoltan Moricz, both of Atlasgatan 1, S-113 20 Stockholm, Sweden

[21] Appl. No.: 915,801

[22] PCT Filed: Dec. 28, 1990

[86] PCT No.: PCT/SE90/00884

§ 371 Date: Jul. 27, 1992

§ 102(e) Date: Jul. 27, 1992

[87] PCT Pub. No.: WO91/11579

PCT Pub. Date: Aug. 8, 1991

[30] Foreign Application Priority Data

Jan. 26, 1990 [SE] Sweden ..... 9000281-7

[51] Int. Cl.[5] ..... E05B 29/00

[52] U.S. Cl. ..... 70/379 R; 70/360; 70/370; 70/391

[58] Field of Search ..... 70/379 R, 380, 419, 70/491, 492, 360, 370, 422, 222, 223

[56] References Cited

U.S. PATENT DOCUMENTS

| | | | |
|---|---|---|---|
| 2,023,208 | 12/1935 | Olson | 70/360 |
| 3,410,123 | 11/1968 | Jacobi . | |
| 3,438,506 | 4/1969 | Groth . | |
| 3,566,637 | 3/1971 | Hallmann | 70/493 |
| 3,570,287 | 3/1971 | Hallmann . | |
| 4,099,395 | 7/1978 | Garza . | |
| 4,418,554 | 12/1983 | Wolfgang | 70/360 |
| 4,448,050 | 5/1984 | Nugent et al. | 70/360 |
| 4,759,204 | 7/1988 | Neyret . | |
| 4,773,240 | 9/1988 | Foshee | 70/380 |
| 4,903,512 | 2/1990 | Leroy et al. | 70/379 R |
| 4,936,895 | 6/1990 | Leclerc et al. . | |
| 5,070,716 | 12/1991 | Whorlow | 70/380 |

FOREIGN PATENT DOCUMENTS

| | | | |
|---|---|---|---|
| 815791 | 6/1969 | Canada | 70/360 |
| 2424391 | 12/1979 | France | 70/491 |

*Primary Examiner*—Peter M. Cuomo
*Assistant Examiner*—Darnell M. Boucher
*Attorney, Agent, or Firm*—Larson and Taylor

[57] ABSTRACT

A burglar proof lock for instance for a door, trunk lid, ignition switch, steering column, etc. of a motor car and of the type which is formed with a rotatable lock cylinder comprising several latch plates which in a predetermined order become partly expelled in the radial direction from the lock cylinder when the key is removed from the lock cylinder. In the expelled position, the lock plates lockingly engage a latch sleeve formed with several inner, annular grooves adapted to receive the latch plates of the lock cylinder in the locked condition of the lock. The lock cylinder can rotate freely in the latch sleeve but can not be moved axially in relation to said latch sleeve in such locked condition. Thus, the lock cylinder in its released condition can be displaced axially in the latch sleeve against the action of a pressure spring, whereby a coupling forming an integral part of the lock cylinder can engage and cooperate with a stationary receiver having an actuation lever or a similar mechanism arranged to directly actuate the door latch, the ignition switch, the steering columns lock, etc.

5 Claims, 2 Drawing Sheets

BURGLAR PROOF LOCK, ESPECIALLY LOCK FOR CARS

FIELD OF THE INVENTION

The present invention generally relates to a locking means, and the invention is more particularly directed to a lock for a door, the trunk lid, the ignition switch, the steering column etc. of a motor car, which lock is designed for making it difficult or impossible to break open the lock.

BACKGROUND OF THE INVENTION

Usually a car lock is formed with a rotatable latch bolt or lock cylinder, generally referred to as a "coded" lock cylinder, which bolt or cylinder cooperates with a latch sleeve or lock sleeve which is stably mounted in the door or any other part of the vehicle. The latch bolt or lock cylinder is formed with several lock plates which become partly pressed out of the lock cylinder when the key is extracted from the cylinder, whereby said lock plates engage one or more axial slots of the latch sleeve thereby making it impossible to rotate the lock cylinder in relation to the latch sleeve. Only a key exclusively designed for the actual lock can be introduced in the lock cylinder. When such a key is introduced in the lock cylinder the lock plates become retracted into the lock cylinder, and said cylinder again can be rotated in relation to the latch sleeve. Said lock cylinder generally actuates a lock arm which releases some blocking means for the door etc, so that the door can be opened, the ingition can be switched on, the steering wheel can be rotated etc.

It is known that many locks of the above mentioned type can be opened in that a heavy screw driver or any other flat tool is introduced into the key hole and is rotated so strongly that the lock plates of the lock cylinder become broken off, whereby the lock cylinder can be rotated in relation to the lock sleeve or latch sleeve, and the door can be opened, the steering wheel can be rotated, the iginition can be switched on etc., an operation which is, of course, not intended and acceptable.

SUMMARY OF THE INVENTION

The invention intends to solve the problem of providing an improved lock of the type which is formed with a rotatable lock cylinder comprising lock plates which become partly expelled of the lock cylinder as soon as the key is being pulled out of the lock cylinder, and in which the lock is formed so that it can not be broken open by means of a screw driver or any other flat tool, or can be unpermittedly opened in any other way.

According to the invention said problem is solved in that the lock sleeve or latch sleeve is formed with several inner, all around the sleeve extending grooves matching the lock plates of the lock cylinder, and in that the lock cylinder is formed axially displacable in the latch sleeve, whereby the lock cylinder, in its normal opening and locking positions, must be located axially displaced in relation to the latch sleeve for making a locking or an unlocking possible. In said axially displaced position the lock cylinder temporarily engages a coupling means connected to the releasing or unlocking means and the locking means for the door bolt, the steering wheel lock pin etc., so that said unlocking or locking means can be actuated for unlocking and locking of the door etc. Preferably the lock cylinder is spring biassed in the key direction, that is out from the lock actuation means of the door, so that the lock cylinder, in its non-actuated condition, always is located in the position enabling an introduction of the lock plates of the lock cylinder in the circular grooves of the latch sleeve.

In a special embodiment of the invention also the latch sleeve is formed rotatable in relation to a lock housing which is stationary mounted in the door, in relation to the steering wheel column etc., so that the lock cylinder, in its locked condition, rotates in the latch sleeve when the key is rotated, and the latch sleeve, concurrently therewith, may rotate in relation to the lock housing.

Further characteristics and advantages of the invention will be evident from the following detailed description of a couple of preferred embodiments of the invention, given as examples only.

DETAILED DESCRIPTION OF THE PREFERRED EMBODIMENTS

Figure 1:
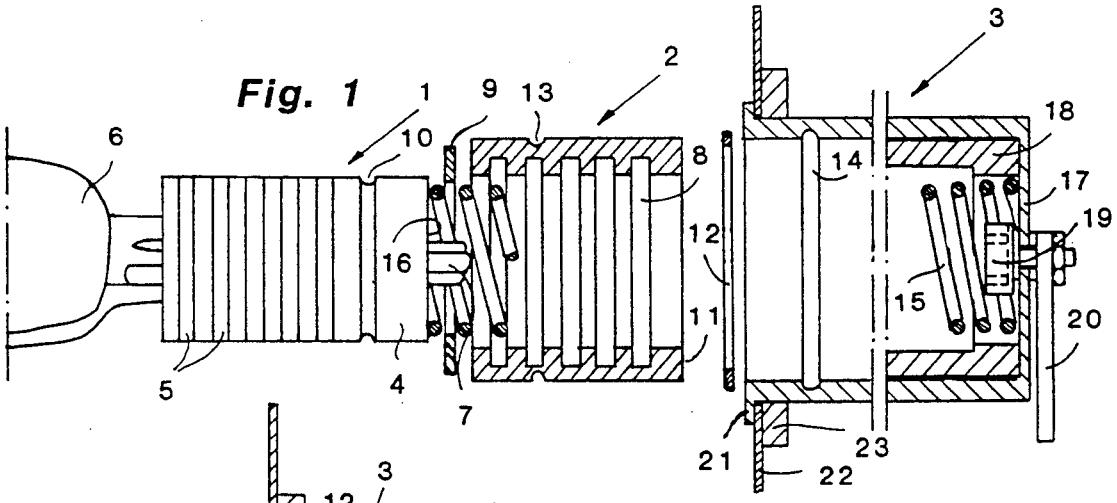
FIG. 1 is a diagrammatical exploded view of a first embodiment of the invention.
Figure 2:
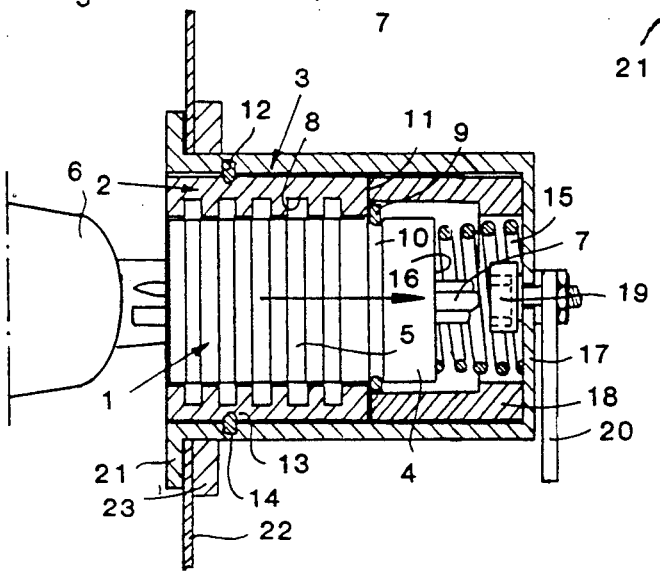
FIG. 2 is a cross section through the apparatus shown in FIG. 1 in its assembled condition and in its released condition, that is the condition in which an allowed key is introduced in the lock cylinder.
Figure 3:
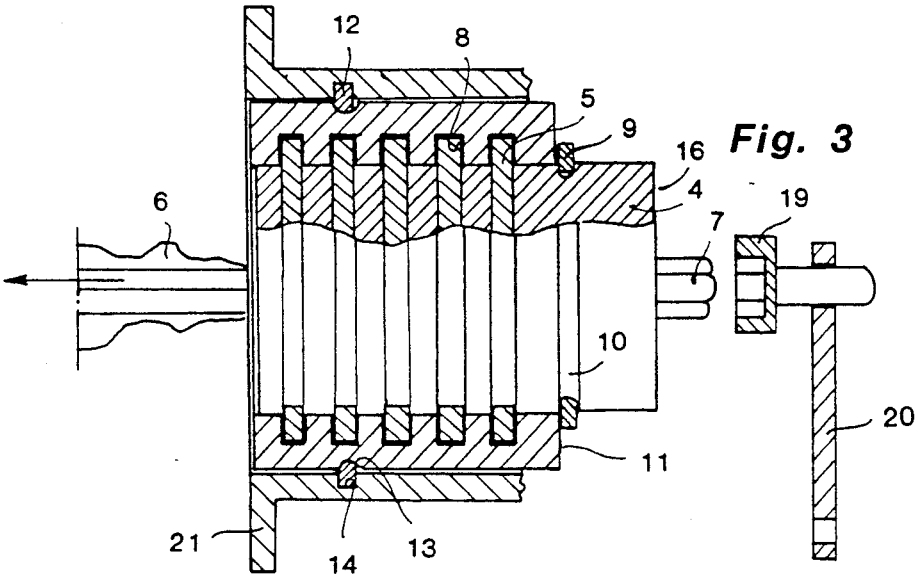
FIG. 3 shows, in a larger scale and in a partial cross section view, a detail of the apparatus in its locked condition, that is after the key has been pulled out of the lock.

The embodiment of the lock shown in FIGS. 1–3 is suited for being mounted in a car door, but it is obvious to the expert that the lock as well can be used for many other purposes, for instance as an ignition switch lock of a motor vehicle, for doors in houses or apartments, and anywhere there is a need for a lock which is more "burglar proof" than many other types of locks, but which is still simple and can easily be installed in all kinds of places, and which can be used as substitutes for other locks mounted in the door etc.

As best evident from FIG. 1 the lock according to the invention comprises three main parts, namely a lock cylinder 1, a latch sleeve 2 and a lock housing 3 as seen from left to right in the drawing.

The lock cylinder 1 basically is of a known type which comprises a cylinder part 4 having several latch plates 5 which can be partly expelled out of the lock cylinder 1, and which, upon introduction of an allowed key 6 in the lock cylinder 1 are being retracted into the cylinder 1, and which upon removal of the key from the lock cylinder 1 are being partly expelled out of the lock cylinder 1.

As usual the latch plates may be of different width, and they are normally "coded" in the cylinder 1, whereby is meant that they are adapted to a special key, so that different sets of latch plates 5 become retracted into the lock cylinder when using different keys, but in which lock all of said latch plates are not retracted into the lock cylinder unless a predetermined, allowed key is introduced in the key. At the end of the lock cylinder, the right end as shown in FIGS. 1-3, which is adapted to be introduced in the lock housing 3, the lock cylinder is formed with a coupling means 7 arranged to be able to cooperate with a counter coupling means mounted at the bottom of the lock housing 3 and connected to a lever or a similar means for providing a locking and a releasing operation of the locking means for the car door, for instance a latch for the lock piston of the door. The coupling means 7 may for instance be a hexagon head adapted to cooperate with an hexagon socket cap at the bottom of the lock housing, but the coupling may be any other means enabling a torque transmittance between the lock cylinder and an acuation means for the latch mechanism of the car door.

The latch sleeve 2 has an inner diameter which matches the outer diameter of the lock cylinder 1. The sleeve 2 is formed with several all around the sleeve 2 extending inner grooves 8, the width, depth and mutual location of which exactly correspond to the dimensions and locations of the latch plates 5 of the lock cylinder 1. This means that the lock cylinder I can be rotated all around in the latch sleeve 2 even when the latch plates 5 are expelled, that is when the key 6 has been removed from the lock cylinder 1. Therefore it is not possible to break off the latch plates (5) by rotating a flat, wedge formed tool in the key hole, and consequently it is not possible to damage and unpermittedly break open the lock - as can be done in many types of previously known locks. Further, there is such great number of latch plates 5, and said latch plates 5 are so wide in the axial direction of the lock cylinder that it can be considered impossible to break open the lock by pressing the lock cylinder 1 inwardly in the latch sleeve 2 in an attempt to break off the latch plates 5 by such axial pressure.

As shown in FIGS. 2 and 3 the lock cylinder 1 is stably connected to the latch sleeve 2 in that a spring ring 9 engages an outer annular groove 10 adjacent the inner end of the lock cylinder 1, and said spring ring 9 provides a shoulder for the inner end surface 11 of the latch sleeve 2.

The latch sleeve 2 is secured in the lock housing 3 by means of a spring lock ring 12 which lockingly engages an outer annular groove 13 of the latch sleeve 2 and an inner annular groove 14 of the lock housing 2. When the lock parts 1, 2 and 3 are assembled and interconnected by means of the spring rings 9 and 12 the parts can not be separated from each other.

A pressure spring 15 engaging between the inner end 16 of the lock cylinder 1 and the bottom 17 of the lock housing 3 biasses the lock cylinder 1 in the direction outwards into press contact between the lock ring 9 and the end surface 11 of the latch sleeve 2.

For adapting the latch sleeve 2 to lock housings 3 of different depths different long spacing sleeves 18 can be mounted at the bottom Of the lock housing 3. The spacing sleeve 18 is formed so that the latch sleeve 2 with the inner end 11 thereof directly contacts the spacing sleeve end, whereby the latch sleeve 2 becomes steadily clamped in the axial direction in the lock housing 3, both by the action of the lock ring 12 and also by the butt contact against the spacing sleeve 18. This makes it impossible to press the latch sleeve 2 with the lock cylinder 1 into the lock housing in an attempt to violently press the coupling means 7 of the lock cylinder 1 into engagement with the receiver means at the bottom of the lock housing 3 thereby un-permittedly break open the door etc.

At the bottom of the lock housing 3 there is a receiver means 19 for the coupling head 7 of the lock cylinder 1. Rotatory movements of the lock cylinder 1 can, via the coupling head 7 thereof, be transmitted to a lever arm 20 connected to the receiver means 19 outside the lock housing 3, which lever arm 20, in turn, is connected to the latch means of the door lock.

The lock housing 3 can be mounted in many ways in the car door, on the outer tube of the steering column, in the instrument panel etc. In the drawings is only diagrammatically shown that the lock housing 3 is formed with an outer flange 21 adapted to engage, for instance, the exterior side of the door 22, and the lock housing 3 is secured on the inner side of the door 22 by means of a locking ring 23.

The above described lock operates as follows:

When an accepted (correct) key 6 is introduced in the key hole of the lock cylinder 1 all latch plates 5 are being withdrawn from the latch sleeve 2, and the lock cylinder 1 can be pressed axially inwards in relation to the latch sleeve 2 against the action of the pressure spring 15. When the lock cylinder 1 has been moved a certain distance into the latch sleeve 2 the coupling head 7 thereof engages the receiver means 19 and the door can be locked or unlocked by rotating the key 6 and thereby the lock cylinder 1 with the coupling head 7, the receiver means 19 and the actuation lever 20 for the door latch or an equivelent means to be actuated by the lock.

When the lock cylinder 1 is then allowed to return to its normal, non-actuated position, in which the lock spring ring 9 of the lock cylinder 1 engages the end 11 of the latch sleeve 2, preferably after the door has been locked, the key can be pulled out of the lock cylinder, and thereby the latch plates 5 are being expelled and each engage one of the may annular inner grooves 8 of the latch sleeve 2. Thereby the lock cylinder 1 is axially blocked in the latch sleeve 2, but it can rotate in the latch sleeve 2. Further, the latch sleeve 2 is axially blocked in the lock housing 3 by means of the lock spring ring 12 which engages the outer groove 13 of the latch sleeve 2 and the inner groove 14 of the lock housing 3. The latch sleeve 2 thereby can rotate freely in relation to the lock housing. In this situation there is is consequently no possibility to have the coupling head 7 of the lock cylinder 1 engage the receiver means 19 at the bottom 17 of the lock housing 3. Also there is no possibility of - unpermittedly and without using the allowed/correct key matching the actual lock cylinder 1 - having the latch plates 5 become withdrawn into the lock cylinder 1 and having said lock cylinder 1 become axially displaced in relation to the latch sleeve 2 and the lock housing 3 for unlocking the car door. Upon an attempt to break open the lock by violent force using a screw driver or a similar tool the lock cylinder 1 and eventually also the latch sleeve 2 only will rotate in the lock housing 3.

Figure 4:
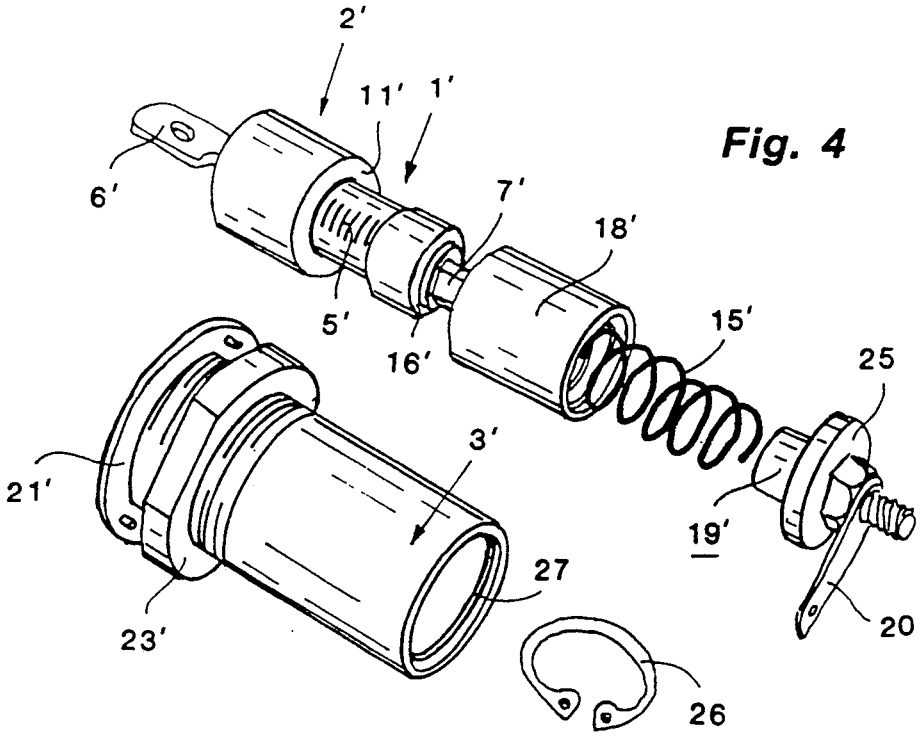
FIG. 4 shows an exploded perspective view of a modified embodiment of a lock according to the invention.
Figure 5:
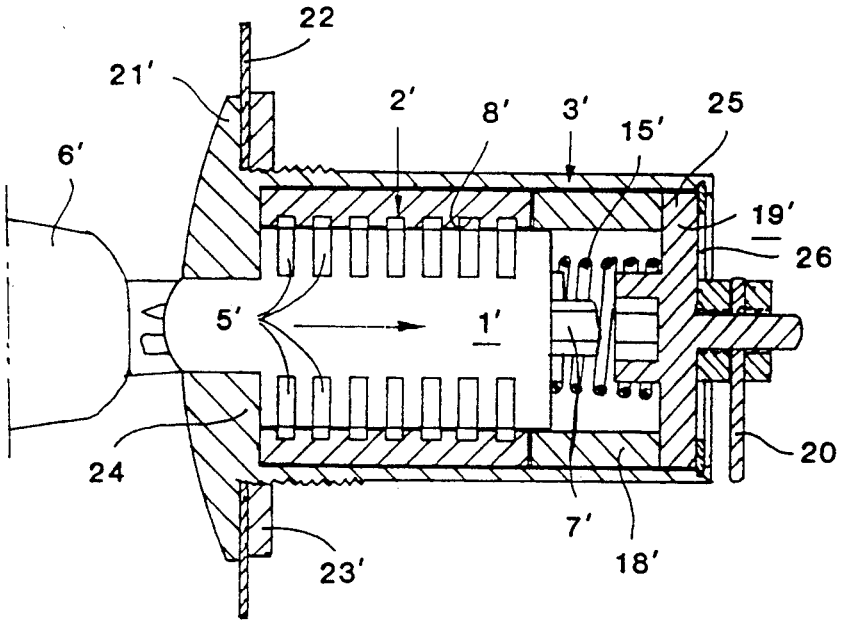
FIG. 5 shows, like in FIG. 2, the lock of FIG. 4 mounted in a car door.

The embodiment of the lock according to the invention shown in FIGS. 4 and 5 mainly differs from the above described embodiment in that the lock cylinder 1' with the latch sleeve 2' and the spacing sleeve 18' are arranged to be introduced in the lock housing 3' from the inner side of the door. For this purpose the end of the lock housing 3', at the door side 22, forms both a radially outward extending flange 21' which keeps the lock housing 3' on place against the door, and a radially inwards extending flange 24 against which the lock sleeve 2' is in contact and is kept clamped by the spacing sleeve 18' and a radial flange 25 of the reciver means 19'. The flange 25, like the latch sleeve 2' and the spacing sleeve 18' has an outer diameter which matches the inner diameter of the lock housing 3'. For the sake of clearness the latch sleeve 2' is in FIG. 4 shown partly slid off the the lock cylinder 1' so that the latch plates 5' appear in the drawing.

The unit consisting of the latch sleeve 2', the spacing sleeve 18' and the receiver means 19' is blocked against an axial displacement in the lock housing 3' by a locking ring 26 engaging an inner annular groove 27 adjacent the "inner" end of the lock housing 3'.

The apparatus of FIGS. 4 and 5 operates identically with the apparatus described in connection to FIGS. 1–3. Thus, the lock cylinder 1' is rotatable in relation to the latch sleeve 2' and the spacing sleeve 18', and the latch sleeve 2' and the spacing sleeve 18' are rotatable in relation to the lock housing 3'. When the key 6' is withdrawn from the lock cylinder 1' the latch plates 5' become partly expelled from the lock cylinder and secured in the grooves 8' of the latch sleeve 2' with the lock cylinder 1' in the position spaced from the receiver means 19' biassed by the spring 15', as shown in FIG. 5.

There is no possibility to break open the lock by breaking the latch plates 5' by means of a screw driver or a similar tool and to move the lock cylinder 1' into the lock housing 3' so that coupling means/head 7' comes into engagement with the receiver means 19'. This is possible only after the "correct" key has been introduced in the lock cylinder 1', whereby the latch plates 5' become withdrawn into the lock cylinder 1', and whereafter the lock cylinder 1' can be moved axially in relation to the latch sleeve 2', the spacing sleeve 18' and the lock housing 3' and into cooperating engagement with the receiver means 19'.

We claim:

1. A burglar proof lock for an element comprising:

a lock cylinder having a longitudinal axis;

a plurality of latch plates mounted in said lock cylinder for radial movement relative to said longitudinal axis between a withdrawn position in which said latch plates are withdrawn radially into said lock cylinder when a matching key is introduced into said lock cylinder and an expelled position in which said latch plates are partly expelled from said lock cylinder when the key is withdrawn from said lock cylinder;

a latch sleeve in which said lock cylinder is located for free rotation about the longitudinal axis thereof and for longitudinal movement only when the key is received therein, said latch sleeve including a plurality of inner circumferential grooves defined by radially extending opposed circumferential walls (a) in which respective ones of said latch plates are received when said latch plates are in the expelled positions whereby said circumferential walls engage respective said latch plates in the expelled position and thus prevent said lock cylinder from moving longitudinally relative to said latch sleeve while allowing free rotation of said lock cylinder and (b) from which said latch plates are withdrawn when said latch plates are in the withdrawn position whereby said lock cylinder is movable longitudinally relative to said latch sleeve;

a lock housing which is stationary relative to the element and in which said latch sleeve is located for free rotation about the longitudinal axis of said lock cylinder so that said lock cylinder is also freely rotatable relative to both said latch sleeve and said lock housing;

a coupling member attached to said lock cylinder which is axially displaceable therewith; and a receiver member attached to said lock housing which cooperates with said coupling member after an axial displacement of said lock cylinder to unlock the element.

2. A burglar proof lock as claimed in claim 1 and further including a blocking means for blocking said latch sleeve against longitudinal displacement relative to said lock housing.

3. A burglar proof lock as claimed in claim 2 wherein said lock cylinder includes a radially projecting stop shoulder adjacent an inner end thereof; and further including a pressure spring located between the inner end of said lock cylinder and an inner end of said lock housing whereby said stop shoulder is biassed into engagement with an inner end of said latch sleeve.

4. A burglar proof lock as claimed in claim 1 wherein said lock housing is cup shaped with a bottom; and wherein said receiver member is attached to said lock housing at said bottom.

5. A burglar proof lock as claimed in claim 4 and further including an actuation lever on an exterior side of said lock housing to which said receiver member is connected whereby movement of said receiver member moves said lever and unlocks the element.

* * * * *